United States Patent [19]

Hauville

[11] 4,118,759

[45] Oct. 3, 1978

[54] BOOK SUPPORT

[76] Inventor: Jean Hauville, Le Crot du Lac, Montillot, France, 89660

[21] Appl. No.: 761,770

[22] Filed: Jan. 24, 1977

[30] Foreign Application Priority Data

Feb. 9, 1976 [FR] France ..... 76 03471
Jan. 7, 1977 [FR] France ..... 77 00313

[51] Int. Cl.[2] ..... F21V 33/00; A47B 97/04

[52] U.S. Cl. ..... 362/98; 248/453; 362/407

[58] Field of Search ..... 240/2 P, 2 R, 6.4 B, 240/52 BL, 52 R, 88, 108 R; 248/445, 446, 454, 451, 453, 441 C; 362/98, 388, 391, 407, 408

[56] References Cited

U.S. PATENT DOCUMENTS

| | | | |
|---|---|---|---|
| 851,627 | 4/1907 | Norton | 240/88 |
| 968,421 | 8/1910 | Ringler | 240/144 X |
| 2,428,649 | 10/1947 | Brown | 240/52 BL |
| 3,351,312 | 11/1967 | Ballas | 248/454 X |
| 3,701,897 | 10/1972 | Pennington et al. | 240/108 X |
| 3,833,197 | 9/1974 | Dyke | 248/441 |

*Primary Examiner*—J. D. Miller
*Assistant Examiner*—Peter S. Wong
*Attorney, Agent, or Firm*—John J. Dennemeyer

[57] ABSTRACT

A book support for maintaining a book in a suspended position comprises a book holder and a light source with a lamp shade. The book holder is supported by the lamp shade which depends from a suspension member, the lamp shade having three arms, two of said arms extending substantially in an orthogonal direction relative to the other two arms, the lamp shade being pivotable in a vertical plane so as to move the book holder on an axis which is parallel to the main axis.

9 Claims, 1 Drawing Figure

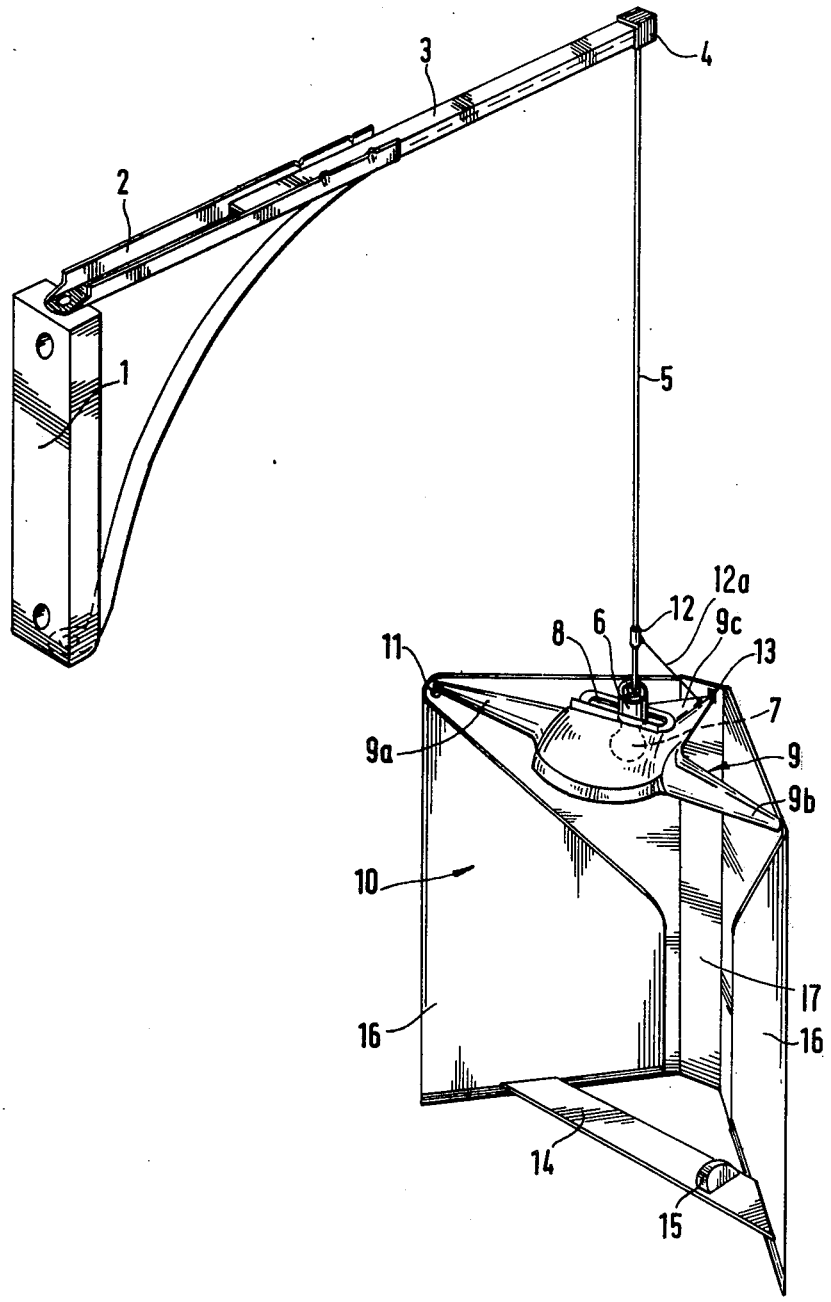
1
2
3
4
5
6
7
8
9
9a
9b
9c
10
11
12
12a
13
14
15
16
16
17

BOOK SUPPORT

The present invention relates to a desk or table type support and more particularly to a support for holding a book in such a way as to facilitate its reading.

Among the devices of this type known already there are desks used for example in hospitals and supported on the bed or its side boards or also of a type mounted on a movable carriage. These devices present the disadvantage of being cumbersome when not in use and not very useful for reading in a reclined position, and generally they are not provided with their own light source.

The device according to the invention eliminates these disadvantages. It makes it possible for a person to read either in a reclined position or in a sitting position. It is also possible to adjust the distance in a horizontal direction, i.e. the depth of the field of lecture, and in a vertical direction, i.e. up or down, the level of the book depending on the position of the reader whether reclined or sitting up.

The proper lighting of the device is an integral part thereof, adapted specifically to the reading and limited to the lighting of the book only, without any inconvenience to the reader himself or any other person in the vicinity.

The book holder is entirely independent of any support on the bed.

The device can be in permanent use without constituting an encumbrance either on the floor or on the bed.

It is mounted on a wall support and may be folded away against the wall after use while keeping the book in its place and requiring a minimum of space.

The device can also be disassembled from its wall support.

It can also be designed esthetically to conform with the rest of the room.

The device according to the invention comprises a movable angle bracket which is mounted on a wall support, e.g. a block or the like which is permanently fixed to a wall for example. The angle bracket has a horizontally extending support arm in the form of a rail which receives a slide bar. The angle bracket is pivotably mounted on the wall block for rotation about a vertical axis so that the device can be moved out of the way against the wall after use.

The outer end of the slide bar is provided with an end piece at which a suspension member that is adjustable in length is secured and at whose lower end a lamp shade is attached which carries on the one hand the light source and on the other hand the book holder suspended from its extremities, and provided itself at its upper part with eyelets for receiving the extremities of the lamp shade. As the center of gravity of an open book is variable depending on the number of pages located on either the left or right side of its back the lamp shade is connected to the lamp support by a sleeve which is slidable along the horizontal axis permitting thus to establish the balance of the book holder according to the changes in the center of gravity.

The book holder has substantially the form of a book cover before the book is bound and whose two inner faces are provided with a fold-over triangular sheet closed at the bottom and the front edge to retain therein the cover of the book which is slid thereinto. A flat cross-band which is secured at the bottom of the book holder maintains the opening angle and supports the pages of the book. A magnetic element or clamp is placed on this flat band to hold the pages back against each book cover.

The various features and advantages of the device according to the invention will be seen more clearly from the detailed description of the invention given hereafter with reference to the accompanying drawing in which the book holder according to the invention is illustrated in a perspective view.

As shown in the single FIGURE of the drawing the device comprises a wall support 1 on which an angle bracket 2 is mounted for horizontal pivoting through an angle of 180°. The angle bracket has a support arm of predetermined length which extends horizontally and an extension bar 3 is adapted to slide in this support arm for regulating the outward extension of the support arm. The extension bar carries at its outer end a stop member 4 at which a suspension member 5 is secured whose length can be adjusted by moving it up or down. A sleeve 6 is fixed to the lower part of the suspension member 5 and receives a lighting element 7. The sleeve 6 is received in an elongated horizontal slot 8 of a lamp shade 9. The lamp shade 9 has substantially the shape of a star having three arms *9a*, *9b* and *9c*. The two first arms *9a* and *9b* extend substantially along a main horizontal axis and the third arm *9c* is approximately perpendicular in relation to the main axis and is positioned in a horizontal plane. The book holder 10 is hooked to the lamp shade 9 at the extremities of the three arms *9a*, *9b* and *9c* of the lamp shade 9. In order to regulate the book holder 10 in the vertical plane the lamp shade 9 may be displaced horizontally in relation to the suspension member 5 which is possible due to the elongated slot 8 provided in the closed upper portion of the lamp shade 9. The lamp shade is designed with respect to the book holder 10 so that they can be separated from each other by disengagement from the extremities of the arms *9a*, *9b* and *9c* whose diameter is reduced so that they can penetrate into openings 11 provided in the upper part of the book holder cover. An electric cable, not shown, passes through the angle bracket and the end piece 4 into the concealed lighting element 7 disposed above the book. The book holder 10 is designed to receive books of varying height, width and thickness without requiring a change. It is held open according to the customary average angle for reading by means of a lower transverse band 14 of metallic material which also supports two magnetic block elements 15 for holding back the pages of the book, one such block being shown in the drawing. The block elements rest on the transverse band by magnetic attraction and hold open the pages of the book. The fold-over sheets of the book holder covers are closed at their front and base sides and opened at their vertical top and inner sides to receive and firmly retain the book covers. The back portion 17 of the book holder is made of an elastic material so as to accommodate between the rigid covers varying thicknesses depending on the number of pages of the book.

When a book is placed on the book holder 10 by introducing the book covers from the top down into the two pockets formed between the covers of the book holder 10 and their fold-over sheets 16 its covers are securely held in position with its pages resting on the flat top portion of the transverse band 14, thus firmly retained in the book holder 10. The attachment of the book holder to the suspension element 5 is effected thereafter by engaging the extremities of the lamp shade arms *9a* and *9b* in the openings 11 provided in the upper part of the book holder 10. The attachment of the extremity of the third arm 9c is made thereafter in a seat 13 fixed at the upper part of the back of the book holder and by being encased in this manner it provides a rigid triangular formation of the unit book holder - lamp shade. The third arm 9c is also connected for example by a cable or rod 12a to a slide member 12 which can be moved along the suspension member 5 so as to vary the reading plane of the book holder either forward or backward relative to its main horizontal axis.

The device according to the invention may be used in all circumstances where a reader interested in his comfort does not wish to carry the weight of the book in his hands and in all cases where he wants to improve his reading by a light source which casts no shades and is always directed on the book while it does not inconvenience other persons in the vicinity.

The device is of particular interest for sick people who are not able to support the weight of a book.

What is claimed is:

1. A book support for maintaining a book in a suspended position for reading, comprising:

a book holder having front and rear portions, and adapted to support an open book therein;

a lamp shade for carrying said book holder, and including a central element having three arms extending therefrom, two of said arms extending along a common, substantially horizontal axis, and the third of said arms being substantially orthogonal to said horizontal axis, said front portions of said book holder being mountable on the free ends of said first two arms, and the rear portion of said book holder being mountable on the free end of said third arm;

a suspension member, said lamp shade being mounted on said suspension member;

means for adjusting said third arm in a substantially vertical plane, so as to pivot said lamp shade and the book holder mounted thereon about said horizontal axis; and a light source located in said central element of said lamp shade.

2. A book support according to claim 1, wherein said suspension member is connected to an angle bracket, said angle bracket being pivotably mountable on a wall support for movement in a horizontal plane, and said suspension member hanging downwardly from said bracket.

3. A book support according to claim 2, wherein said suspension member includes a sleeve mounted at the lower end thereof, said central element of said lamp shade being mounted on said sleeve, and wherein said light source is carried by said suspension member.

4. A book support according to claim 3, wherein said central element of said lamp shade has an elongated slot therein extending along said horizontal axis, within which said sleeve of said suspension member is slidably received, whereby said lamp shade can be moved laterally of said suspension member.

5. A book support according to claim 1, including additionally:

a slide element mounted on said suspension member, and slidable vertically therealong; and means connecting the free end of said third arm with said slide element, whereby said third arm and said book holder can be pivoted about said horizontal axis by vertically adjusting the position of said slide element, for adjusting the reading position of a book carried by said book holder.

6. A book support according to claim 5, wherein said book holder has essentially the form of an open book cover, and includes:

a rigid front cover;

a rigid back cover;

a back portion interconnecting the rear edges of said front and back covers;

said front and back covers each having a foldover sheet of substantially triangular shape extending over their inside faces and closed at the front and bottom sides; and a rigid metal band extending between said front and back covers at their lower ends, to maintain the book holder in a predetermined open position, and to provide support for magnetic blocks receivable on said band and usable to hold back the pages of an open book resting on said band and carried by said book holder, the covers of said book being receivable in said foldover sheets.

7. A book support according to claim 6, wherein said central element of said lamp shade has an elongated slot therein extending along said horizontal axis, within which said sleeve of said suspension member is slidably received, whereby said lamp shade can be moved laterally of said suspension member to compensate for different book weights bearing on the opposite ends of said band.

8. A book support according to claim 7, wherein said lamp shade central portion is in the form of a star, with said three arms extending approximately in a horizontal plane.

9. A book support according to claim 6, including additionally:

means at the upper, front corners of said front and back covers of said book holder for connecting said covers to the free ends of said first two arms; and means at the upper end of said back portion for connecting said free end of said third arm thereto.

* * * * *